United States Patent [19]

Pezzulo et al.

[11] Patent Number: 4,954,366

[45] Date of Patent: Sep. 4, 1990

[54] METHOD FOR THE METALLIZATION OF A LUMINESCENT SCREEN

[75] Inventors: Antimo Pezzulo, Anagni; Himanshu Patel, Rome, both of Italy

[73] Assignee: Videocolor, Montrouge, France

[21] Appl. No.: 259,906

[22] Filed: Oct. 19, 1988

[30] Foreign Application Priority Data

Oct. 20, 1987 [FR] France ..... 87 14430

[51] Int. Cl.[5] ..... B05D 5/06

[52] U.S. Cl. ..... 427/68; 427/64; 427/226; 427/380; 427/407.2

[58] Field of Search ..... 427/64, 68, 226, 380, 427/407.2

[56] References Cited

U.S. PATENT DOCUMENTS

| | | | |
|---|---|---|---|
| 3,317,337 | 5/1967 | Saulnier | 427/68 |
| 3,574,663 | 4/1971 | Schniepp | 427/68 |
| 3,579,367 | 5/1971 | Patel | 427/68 |
| 3,582,390 | 6/1971 | Saulnier | 427/68 |
| 4,122,213 | 10/1978 | Ito et al. | 427/64 |
| 4,139,657 | 2/1979 | Watanabe | 427/64 |
| 4,327,128 | 4/1982 | Levine et al. | 427/64 |
| 4,339,475 | 7/1982 | Hinosugi et al. | 427/64 |

*Primary Examiner*—Janyce Bell

*Attorney, Agent, or Firm*—Oblon, Spivak, McClelland, Maier & Neustadt

[57] ABSTRACT

A method for the metallization of a luminescent screen comprises the following steps:

the depositing, in a known way, of a layer of at least one luminophor containing, among others, a binder on a transparent face panel;

the depositing, on said layer, of a sub-layer consisting of an aqueous emulsion of a water-insoluble resin, the emulsion being neutral or alkaline and being capable of forming a hydrophobic film;

the drying of the sub-layer;

the depositing, on said sub-layer, of a coating consisting of an aqueous emulsion of a water-insoluble film-forming resin, said emulsion containing 0.1% to 4.0% by weight of hydrogen peroxide, 0.25% to 2.5% by weight of a water-soluble polymer and 0.1% to 1.0% by weight of colloidal silica, the drying of the coating;

the depositing of a metallic layer, and the volatilizing of the binder, the sub-layer and the coating.

5 Claims, 1 Drawing Sheet

METHOD FOR THE METALLIZATION OF A LUMINESCENT SCREEN

BACKGROUND OF THE INVENTION

1. Field of the Invention

The present invention concerns a method for the metallization of a luminescent screen. More particularly, it concerns a method for depositing an organic film, which can be eliminated by heat, on the luminophors of a luminous screen used especially in color television tubes or color display monitors.

2. Description of the Prior Art

As described in the U.S. Pat. No. 3,582,390, one of the commonly used methods for the metallization of a luminophor screen for cathode ray tubes consists in producing, on the surface of the luminophor screen, a volatilizable substrate which can be obtained from an aqueous emulsion of a water-insoluble film-forming resin, depositing a metallic layer on the substrate and then eliminating the substrate by volatilization. To enable the substrate to be volatilized, the metallic layer should therefore have sufficient porosity. Hence, to adjust the porosity of the metallic layer, the aqueous emulsion contains a small quantity of hydrogen peroxide and an organic polymer forming a water-soluble film. Other additives, such as colloidal silica, can be added to the emulsion. The additives improve adhesion and reduce the formation of blisters in the metallic layer.

This manufacturing method has proved to be quite satisfactory for making the dot type screens which used to be manufactured until the nineteen seventies. Since then, a striped type of screen structure has come into use in industry. With screens of this type, the irradiation systems used are highly sophisticated and, hence, very expensive. Hence, to reduce the initial investment, far more sensitive slurries are used to obtain the luminophor. In this case, the basic photo-polymer system still has polyvinyl alcohol as a binder along with an ammonium, sodium or potassium dichromate as a photo-sensitizer. However, to increase the sensitivity of the luminophor slurry to ultraviolet light by a factor of about 2, substantial quantities of additives, such as ethylene glycol, triethylene glycol and methyl pyrrolidone are added to this slurry. Unfortunately, these additives also act as softeners of the photo-polymer and leave a polymer film with a soft consistency in the luminophor stripes. Thus, after the luminophor screen is deposited, the polymer in the luminophor stripes has a soft consistency which depends on the color depositing sequence. Thus, when the volatilizable substrate is made, when additives such as hydrogen peroxide are used in the aqueous resin emulsion forming a film, as described in the U.S. Pat. No. 3,582,390, the etching of the polymer by hydrogen peroxide becomes highly selective depending on the sequence in which the luminophor colors are deposited. This results in an unequal tightness of film and a loss of luminescence of the tube occurs, at least for the last color deposited, due to over-etching by hydrogen peroxide.

An aim of the present invention is to overcome these drawbacks and to prevent the selective etching of the polymer in the luminophor stripes of different colors.

SUMMARY OF THE INVENTION

Consequently, an object of the present invention is a method for the metallization of a luminescent screen comprising the following steps:

- the depositing, in a known way, of a layer of at least one luminophor containing, among others, a binder on a transparent face panel;
- the depositing, on the said layer, of a sub-layer consisting of an aqueous emulsion of a water-insoluble resin, the emulsion being neutral or alkaline and being capable of forming a hydrophobic film;
- the drying of the sub-layer;
- the depositing on said sub-layer of a coating consisting of an aqueous emulsion of a water-insoluble film-forming resin, said emulsion containing at least hydrogen peroxide and a water-soluble polymer;
- the drying of the coating;
- the depositing of a metallic layer, and
- the volatilizing of the binder contained in the luminophor layer, the sub-layer and the coating;

Preferably, the water insoluble film-forming resin contains 0.1% to 4.0% by weight of hydrogen peroxide, 0.25% to 2.5% by weight of a water-soluble polymer and 0.1% to 1% by weight of colloidal silica.

The use of a neutral or alkaline resin forming a hydrophobic coat hence delays and equalizes the etching, by hydrogen peroxide, of the polymer contained in the luminophor stripes. Thus, in using the method of the present invention, the selective etching of the luminophor stripes, which occurs during the formation of the volatilizable substrate, is eliminated. This method also prevents excessive formation of holes and cracks in the film, whereas such holes and cracks normally appear in this film and, sometimes, on the second color deposited.

Preferably, the water-soluble resins used for the sub-layer or coat consist of acrylate resin copolymers. The term "acrylate resin copolymers" designates copolymers consisting of a combination of alkyd acrylates, alkyd methacrylates, acrylic acid, methacrylic acid and similar acrylate type monomers. Moreover, the water-soluble polymer is chosen from a group consisting of the polyvinyl alcohols, the boric acid/polyvinyl alcohol complex compounds, methyl cellulose and hydroxymethyl cellulose.

Furthermore, the volatilizing is done by heating the screen in air at a temperature between 350° C. and 500° C.

Other features and advantages of the present invention will emerge from the following description, made with reference to the appended drawing wherein:

DESCRIPTION OF A PREFERRED EMBODIMENT

Figure 1:
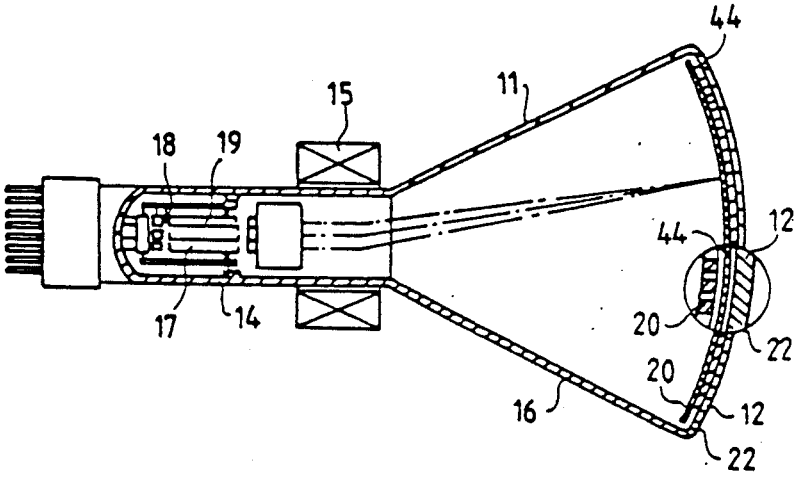
FIG. 1 shows a schematic sectional view of a cathode tube provided with a screen according to the present invention.

FIG. 1 shows a schematic view of a color television tube of standard structure. This tube has a envelope 11 consisting of a face panel 12, made of a transparent material, a neck 14 and a flared portion 16 connecting the neck 14 and the face panel 12 with each other. A luminescent screen is made on the internal surface of the face panel 12. Three electron guns, 17, 18 and 19 are mounted in the neck 14 to emit three individual electron beams, each controlled by video signals representing the colors green, blue and red respectively. Magnetic devices 15 are provided in a known way around the neck, to achieve, in particular, the convergence and deflection of the electron beams. Furthermore, a perforated mask 20 is provided between the electron guns 17, 18 and 19 and the display screen in a well known way.

Figure 2:
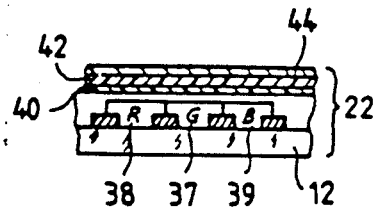
FIG. 2 shows an enlarged sectional view showing the structure of the screen before the final heating.

As shown in FIG. 2, the display screen 22 has, on the face panel 12, a set of parallel lines or stripes 37, 38 and 39 made of luminophor materials, capable of respectively emitting the colors, green (G), red (R) and blue (B). Each line or stripe, 37, 38 and 39, can emit only one color. Each electron gun, 17, 18 and 19, is pointed towards one of the colors, so that the electron beam coming from each of the guns excites only one color. This mask type of television tube is well known to those skilled in the art.

In the commonly used manufacturing method, the various layers forming the luminescent screen 22 are made on the face panel 12 of the tube before sealing this face panel into the flared portion 16 of the envelope 11. To make the screen, the face panel 12 is mounted on a suitable supporting device and a slurry of suitable luminophor material is applied to this screen. The slurry comprises, notably, the desired luminophor, an organic polymer such as polyvinyl alcohol, a suitable photo-sensitizer such as ammonium dichromate, sodium dichromate or potassium dichromate and de-ionized water. In recent years, with the highly automated and highly sophisticated irradiating systems that are used, additives such as glycol ethylene, glycol triethylene and methyl pyrrolidone are added to the luminophor slurries to reduce the exposure time. The quantity added is 30% to 100% by weight of polyvinyl alcohol for example. Furthermore, all the additives used to reduce the exposure time have a high boiling point, between 150° and 220° C. They also act as softeners for the photo-polymer contained in the structure of the luminophor stripe, and keep it above its softening point.

The slurry is distributed throughout the surface of the face panel by tilting and making it rotate. The screen is then rotated at high speed to remove excess slurry. Then the slurry is dried with infra-red driers. The slurry coat is then irradiated with suitable light rays through a perforated mask to record the pattern of the stripes, for example 37, of one of the colors on the dried slurry layer. The light irradiation causes the slurry to polymerize and makes the irradiated surfaces insoluble in water. The non-irradiated portions of the slurry layer are then removed by simply washing the face panel with water. This washing leaves the pattern of luminophor stripes. The panel is then dried to remove water. This general procedure is repeated twice to deposit the other two luminophor stripes 38, 39. The normal depositing sequence for the three luminophor colors is generally green, blue and red.

When the depositing of the luminophor screen is over, the face panel is held in a suitable supporting device to deposit a sub-layer 40 of a hydrophobic film according to the present invention. The supporting device used can rotate at different speeds between 6 and 200 rpm. The face panel provided with the luminophor screen is rotated in a vertical position at a speed of 20 to 60 rpm. The face panel may be dry or wet after the development of the red luminophor screen which is the last color deposited. A quantity of 200 to 500 ml of an aqueous emulsion of a water-insoluble film-forming resin is deposited on the face panel. The face panel is rotated at high speed, between 60 and 200 rpm, for 5 to 30 seconds to remove excess emulsion. The face panel is then heated during and/or after the rotation at high speed to form a film 40. According to the present invention, the emulsion is an aqueous emulsion of a water-insoluble resin which is neutral or alkaline and has the capacity to form a hydrophobic film. Preferably, the water-insoluble resin will consist of an acrylate resin copolymer. The term acrylate resin copolymer refers to combinations of alkyd acrylate, alkyd methacrylate, acrylic acid, methacrylic acid and similar acrylate type monomers.

Before this sub-layer is applied, the polymers of the red, blue and green luminophor stripes have different softening points and hydrophylic properties. The polymer in the red color is the softest and most hydrophylic polymer and the polymer in the green or first color deposited is the hardest and the least hydrophylic polymer. The resin forming the sub-layer is absorbed in the luminophors and, after drying, it produces a substrate showing similar resistance to hydrogen peroxide and water for all three colors of the luminophor screen.

The screen is then rotated in the vertical position and dried by radiant heat. After the sub-layer 40 is totally dried, an aqueous emulsion of a water-insoluble film-forming resin is spread over the face panel in the same way as the emulsion to form the sub-layer. This sub-layer contains 0.1% to 4.0% by weight of hydrogen peroxide, 0.25% to 2.5% by weight of a water-soluble polymer, and 0.1% to 1.0% by weight of colloidal silica. Because of the sub-layer, the luminophor screen has substantially the same hardness and the same hydrophylic properties for all the green, blue or red luminophor stripes during the application of the above emulsion. Thus, a selective etching of the binder, formed by polyvinyl alcohol in the differently colored luminophor stripes, is prevented and a uniform film thickness is obtained with equal penetration as well as similar porosity for all three colors The screen is then dried to obtain a film 42. Then, a metallic layer 44, such as an aluminium layer, is deposited in a known way, generally by vacuum evaporation. Then, the screen is heated in air at a temperature between 350° C. and 500° C. to volatilize the binder contained in the luminophor layers and to volatilize the sub-layer and the coating. With the above process, a screen is obtained with substantially improved reflectivity, namely, a reflectivity of 40 to 50%.

The following are embodiments of aqueous emulsions used to make the sub-layer and coating in the above-described method.

The emulsion used to make the above-described sub-layer is an aqueous emulsion of a water-insoluble film-forming resin with the following properties:

1. Neutral or alkaline resin so that there is no contrary reaction with the sulphur-based luminophors.
2. Capacity to form a hydrophobic film after drying so as to delay the etching of the luminophor screen by hydrogen peroxide and to achieve nearly equal etching for the luminophor stripes of all three colors.

The emulsions forming a film that give the sub layer for the specific examples described below are prepared with the following solutions:

SOLUTION A: an aqueous emulsion containing about 46% of an acrylate resin copolymer emulsified in water, and with a pH between 9 and 10. An emulsion of this type is marketed under the brand name RHOPLEX AC-73 by the firm ROHM and HAAS Co., Philadelphia;

SOLUTION B: aqueous emulsion containing about 46% of an acrylate resin copolymer emulsified in water, and with a pH between 8 and 9.5. An emulsion of this type is marketed under the brand name RHOPLEX C-72 by the firm ROHM and HAAS Co., Philadelphia, and by HITACHI CHEMICALS, Japan.

Example 1: sub-layer containing 9.0% of RHOPLEX AC-73. The sub-layer is obtained by mixing 195 g of solution A with 850 grams of de-ionized water. This mixture was stirred for about two hours with a rotary mixer.

Example 2: sub-layer containing 10% of RHOPLEX C-72. The sub-layer is obtained by mixing 17 g. of solution B with 783 g. of de-ionized water. This mixture was stirred for two hours with a rotary mixer.

The emulsion forming a film used for the coating deposited on the sub-layer for the specific examples described below can be prepared with the following solutions: the aqueous emulsion used is similar to the one described in the U.S. Pat. No. 3,582,390.

SOLUTION A: aqueous emulsion containing about 38% of an acrylate resin copolymer emulsified in water, and with a pH of about 3. An emulsion of this type is marketed under the brand name RHOPLEX B-74 by the firm ROHM and HAAS Co., Philadelphia.

SOLUTION B an aqueous solution containing about 2% of a boric acid/polyvinyl alcohol complex compound. A boric acid/polyvinyl alcohol complex compound of this type is marketed under the brand name UNISIZE HA70 by the firm AIR REDUCTION Co., New York.

SOLUTION C: an aqueous solution containing 30% of hydrogen peroxide.

SOLUTION D: an aqueous solution containing about 30% of colloidal silica such as LUDOX, marketed by E. I. DUPONT.

The coating film has the following composition: 14.5% of RHOPLEX B-74, 0.5% of UNISIZE HA70, 0.5% of hydrogen peroxide and 0.5% of LUDOX AM. The pH of the emulsion is adjusted to 7.1 by ammonium hydroxide ($NH_4OH$). This emulsion is obtained by mixing 381 g. of solution A with 337 g. of de-ionized water. During the mixing, 16 g. of the solution C, 7 g. of the solution D and 250 g. of the solution B was added. Then, while continuing the mixing, a sufficient quantity of ammonium hydroxide was added to set the pH of the final mixture at 7.1.

In the above formulations, the resin concentration in the sub-layer may be adjusted so as to obtain the desired resistance to hydrogen peroxide. Similarly, the hydrogen peroxide concentration in the final coating can also be adjusted to obtain the cracks and pinholes sought for the film covering the luminophor stripes.

What is claimed is:

1. A method for the metallization of a luminescent screen comprising the following steps:
   - depositing a layer of at least one luminophor containing a binder on a transparent face panel;
   - depositing on said layer a sub-layer consisting of an aqueous emulsion of a water-insoluble resin, the emulsion being neutral or alkaline and being capable of forming a hydrophobic film;
   - drying of the sub-layer;
   - depositing on said sub-layer a coating consisting of an aqueous emulsion of a water-insoluble film-forming resin, and at least hydrogen peroxide and a water-soluble polymer;
   - drying the coating;
   - depositing a metallic layer, and
   - volatilizing the binder contained in the luminophor layer, the sub-layer and the coating.

2. A method according to claim 1 wherein the aqueous emulsion forming the coating contains at least 0.1% to 4.0% by weight of hydrogen peroxide, 0.25% to 2.5% by weight of a water-soluble polymer and 0.1% to 1% by weight of colloidal silica.

3. A method according to claim 1 wherein the water-insoluble resins are acrylate resin copolymers.

4. A method according to any of the claims 1 and 2, wherein the water-soluble polymer is chosen from the group consisting of polyvinyl alcohols, the boric acid/-polyvinyl alcohol complex compounds, methyl cellulose and hydroxymethyl cellulose.

5. A method according to any of the claims 1 to 3 wherein the volatilization is achieved by heating the screen in air to a temperature between 350° C. and 500° C.

* * * * *